US005971039A

United States Patent [19]

Webb

[11] Patent Number: 5,971,039

[45] Date of Patent: Oct. 26, 1999

[54] FUEL BARGE FACILITY

[75] Inventor: R. Michael Webb, Eau Claire, Wis.

[73] Assignee: U-Fuel, Inc., Eau Claire, Wis.

[21] Appl. No.: 08/968,032

[22] Filed: Nov. 12, 1997

[51] Int. Cl.[6] ..... B65B 1/04

[52] U.S. Cl. ..... 141/98; 141/86; 141/311 A; 222/608; 114/256; 114/74 A

[58] Field of Search ..... 222/108, 608; 141/98, 86, 311 A; 114/256, 74 A, 228, 227, 263, 260

[56] References Cited

U.S. PATENT DOCUMENTS 3,076,205 2/1963 Schultz .
3,941,272 3/1976 McLaughlin ..... 220/9
4,988,020 1/1991 Webb ..... 222/108
5,400,924 3/1995 Brodie ..... 222/108

*Primary Examiner*—Steven O. Douglas
*Attorney, Agent, or Firm*—Knoble & Yoshida LLC

[57] ABSTRACT

An automated marine refueling facility for effecting marine fueling transactions includes a buoyant platform that is adapted to float above a water level in a body of water such as a lake and a storage tank that is mounted to said platform for storing a quantity of fuel. A pumping system is provided for permitting a customer to refuel a boat from fuel that is extracted from said storage tank. The pumping system is grounded so as to avoid electrical discharges. This facility is advantageous in that it permits a fueling transaction to be performed without an excess of unprotected piping between the storage tank and the boat, thereby reducing the potential for accidents and marine pollution.

14 Claims, 5 Drawing Sheets

FUEL BARGE FACILITY

BACKGROUND OF THE INVENTION

1. Field of the Invention

This invention relates to the field of portable automated fueling facilities of the type that are deployable at a desired location and that do not need an attendant to effect a refueling transaction. More specifically, this invention relates to a barge mounted fueling facility that is adapted for marine refueling transactions, and that is adapted to minimize the risk of significant environmental pollution.

2. Description of the Related Technology

Nearly all marinas have facilities of some type for refueling. The most prevalent type of marine refueling facility includes an above or below-ground storage tank and an above-ground pumping module which is operated by an attendant, much in the manner of commercial service stations for automobiles.

One significant disadvantage of below ground marine refueling stations is the time and labor involved in preparing for and constructing such a facility. Some factors which contribute to the expense of constructing a below-ground facility include the need for construction permits, subcontractors, excavation and the time and planning involved in locating a permanent site for the facility. Once installed, such facilities can not practically be moved to different locations at the marina, to other marinas, or be sold. Above-ground tanks avoid many of the problems discussed above, but present other problems. For example, an above-ground tank will float in high water, so it must be secured to the ground in areas where flooding is a realistic possibility. Similarly, it is not uncommon for below ground tanks to rise in areas that have a high water table or that are prone to flooding.

Another disadvantage of the typical marine refueling facility is that the pumping station is typically located a good distance away from the boat that is being refueled. It is not uncommon to find systems where the tank is positioned on the shore with piping and hoses running hundreds of feet to a dispenser on a dock or a pier. Since most fuel system leaks occur in the piping, and since marine dispensing systems are in constant movement, many marine fuel systems leak into lakes and waterways, which is not easily detectable since the fuel floats away from the spill location and mixes with the water. Many times, hoses become submerged in the water, and pulled around objects, increasing the risk of rupture and contamination.

In many marinas, it is difficult for a marine pilot to refuel his or her water craft at irregular times when an attendant is not present at the marina's refueling facility. As a result, a boat may be effectively prevented from beginning or resuming boating activities until an attendant is again on duty.

When storing volatile liquids such as fuel, it is important that the loss of vapor to atmosphere be minimized, both for fuel conservation and ecological considerations.

When refilling a fueling facility, it is also important that the operator in charge of such refilling be warned when the fuel level in the storage tank approaches capacity, thereby avoiding a spill due to overfilling the tank.

When a large fuel capacity is required for a marina, it is important to modularize the fuel storage such that, in case of impact by a boat, only the breached module will leak, thus limiting the amount of fuel that is spilled.

It is clear there has existed a long and unfilled need in the prior art for an improved marine refueling facility that is as isolated as possible from potential sources of combustion, that minimizes the amount of unprotected piping or hose from the fuel storage tank to the area where fuel is being dispensed, that is secondarily contained, preventing contamination in the event of a spill or a leak in the primary tank, that is resistant to conduction of electricity and corrosion, and that is easily movable in the event of a flood or high water, all for environmental reasons and for reasons of fire safety.

SUMMARY OF THE INVENTION

It is therefore an object of the invention to provide an improved marine refueling facility that is as isolated as possible from potential sources of combustion, that minimizes the amount of unprotected piping or hose from the fuel storage tank to the area where fuel is being dispensed that is secondarily contained, preventing contamination in the event of a spill or a leak in the primary tank, that is resistant to conduction of electricity and corrosion, and that is easily movable in the event of a flood or high water, all for environmental reasons and for reasons of fire safety.

It is further an object of the invention to provide such a system wherein the fuel storage area is modular, allowing fuel capacity to be increased by manifolding.

In order to achieve the above and other objects of the invention, an automated marine refueling facility for effecting marine fueling transactions includes a buoyant platform that is adapted to float above a water level in a body of water such as a lake; a storage tank mounted to the platform for storing a quantity of fuel; and a pumping system for permitting a customer to refuel a boat from fuel that is extracted from the storage tank; whereby a fueling transaction can be performed without an excess of unprotected piping between the storage tank and the boat, thereby reducing the potential for accidents and marine pollution.

According to a second aspect of the invention, a method for refueling a marine craft such as a boat includes steps of positioning the marine craft next to a floating refueling facility; refueling the marine craft by using the floating marine facility; and moving the marine craft away from the facility, whereby a fueling transaction can be performed without an excess of unprotected piping between the storage tank and the marine craft, thereby reducing the potential for accidents and marine pollution.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
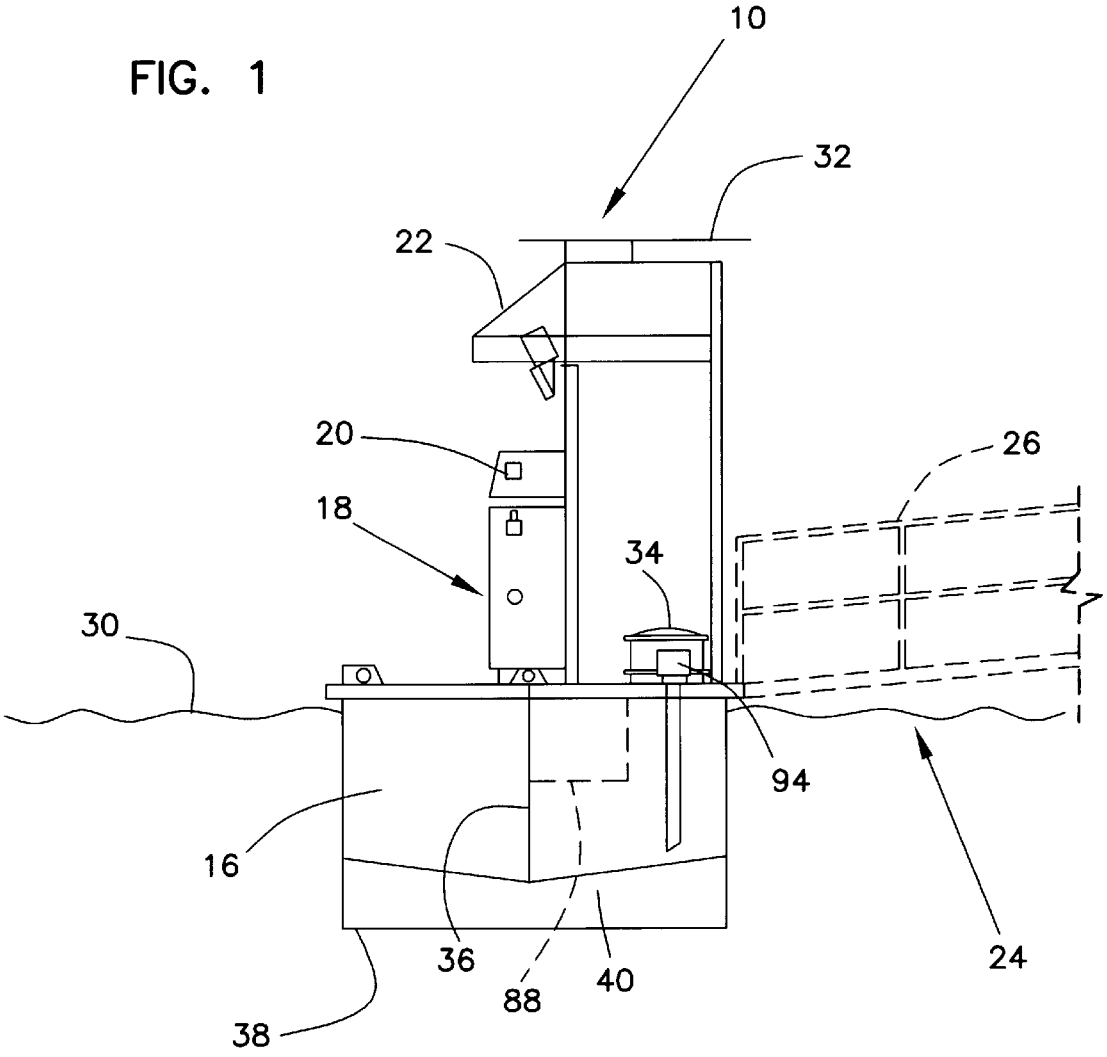
FIG. 1 is a diagrammatical side elevational view of an automated marine refueling facility that is constructed according to a preferred embodiment of the invention.
Figure 2:
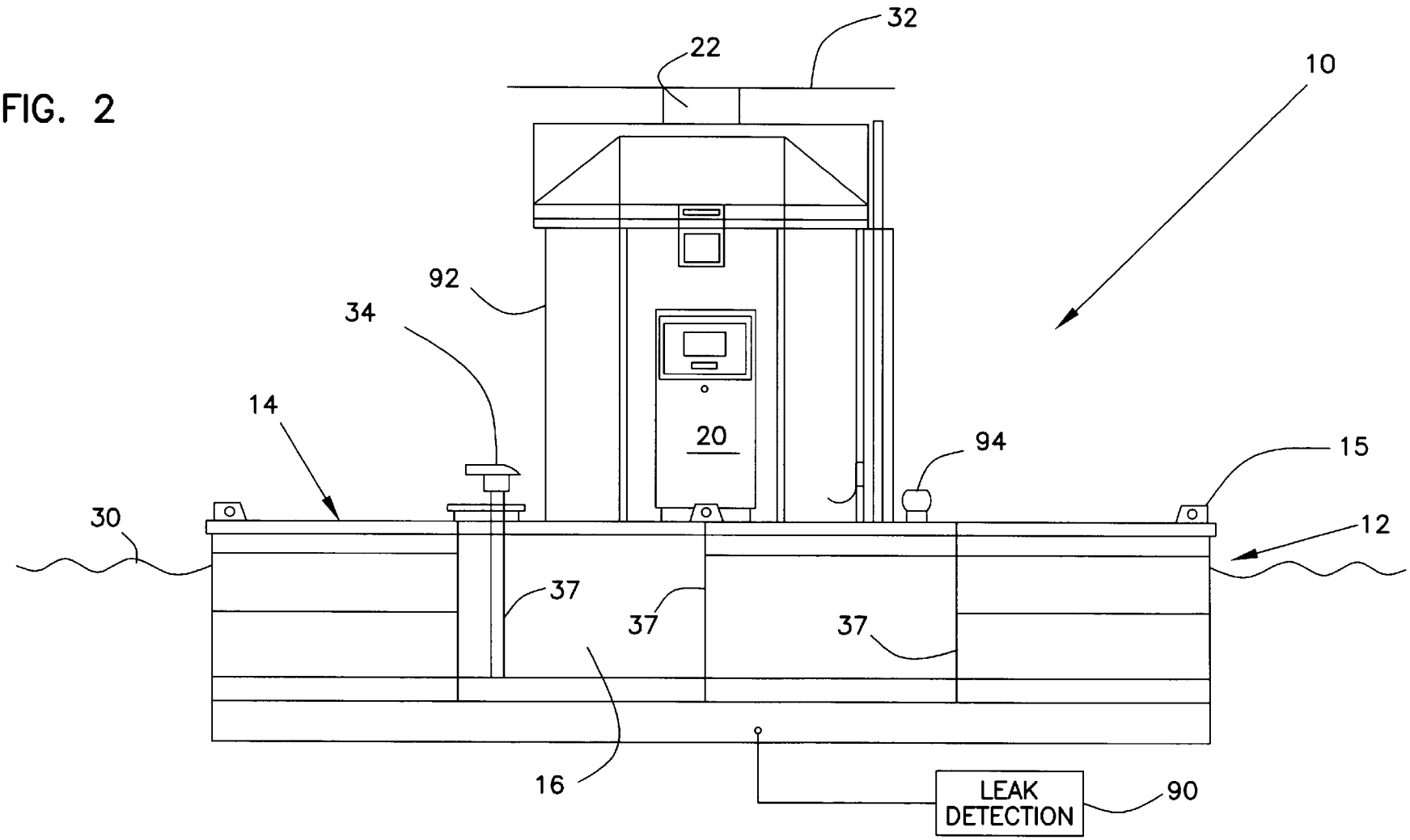
FIG. 2 is a diagrammatical front elevational view of the facility that is shown in FIG. 1.

Referring now to the drawings, wherein like reference numerals designate corresponding structure throughout the views, and referring in particular to FIGS. 1 and 2, an automated marine refueling facility 10 that is constructed according to a preferred embodiment of the invention is designed for effecting marine fueling transactions in a manner so as to be as isolated as possible from potential sources of combustion, and so as to minimize the amount of unprotected piping or hose from the fuel storage tank to the area where fuel is being dispensed, both for environmental reasons and for reasons of fire safety.

Automated marine refueling facility 10 includes a buoyant platform 12 that is embodied as an unpowered barge 14 which is adapted to float above a water level in a body of water such as a lake. Barge 14 is sized so as to be easily transportable by truck or air from one body of water to another as is necessary, and is constructed to ease such transportation, as by the provision of lifting lugs 15 on upper portions of the platform 12.

As may best be seen in FIG. 1, a storage tank 16 is mounted to the barge 14 for storing a quantity of fuel such as gasoline or diesel fuel. A pumping system 18 is also provided on the barge 14 for permitting a customer to refuel a boat from fuel that is extracted from the storage tank storage tank 16. Pumping system 18 includes an automated pump 20 that is automated so as to permit a fueling transaction to be performed without the aid of an attendant, and that preferably includes a system for receiving payment information, such as a credit card or debit card, from a customer. Automated pump 20 is most preferably of the type that is commercially available from Gas Boy International of Lansdale, Pa. as Model 9853 or Universal EPS, and is substantially the same as those described in U.S. Pat. Nos. 4,988,020, 5,562,162 and 5,305,926 to Webb, the disclosures of which are hereby incorporated by reference as if set forth fully herein. Pumping system 18 further includes a hood 22, which is also available from U-Fuel Inc. and is described in U.S. Pat. No. 5,562,162.

Looking again to FIG. 1, it will be seen that a system 24 for grounding the assembly 10 and for anchoring the barge 14 in a fixed position is embodied as a walkway 26 that is physically secured to the barge 14 at one end, and to a dock 28 at a second end. Walkway 26 is preferably formed of an electrically conductive material such as aluminum, or at least includes an electrically conductive portion that helps ground the refueling facility 10. This act to prevent a buildup of electrical potential that could otherwise be discharged during a fueling transaction.

As may be seen in FIGS. 1 and 2, barge 14 is constructed so that the storage tank 16 is at least partially submerged beneath a water level 30 during operations, whereby the body of water will have a moderating effect on the temperature of fuel that is contained within the storage tank 16. The storage tank 16 further includes at least one longitudinally-oriented internal baffle 36, which adds strength and acts to retard shifting of the fuel within the tank 16, thereby enhancing the float stability of the platform 12. Specifically, the longitudinally-oriented baffle 36 keeps the facility 10 from rocking. Tank 16 further includes a number of transverse baffles 37, which in the preferred embodiment number three. Transverse baffles 37 add strength and provide stability against rocking in the longitudinal direction. Stability is particularly important in facility 10 because it will be used as a fueling platform.

As may be seen in FIG. 1, the top fill system 34 is removable to expose a manway by which maintenance personnel can access the inside of tank 16. In addition, baffle manways 88 are defined in both the transverse and longitudinally-oriented baffles so that maintenance personnel are able to access all of the compartments, for inspection and to repair leaks.

Figure 3:
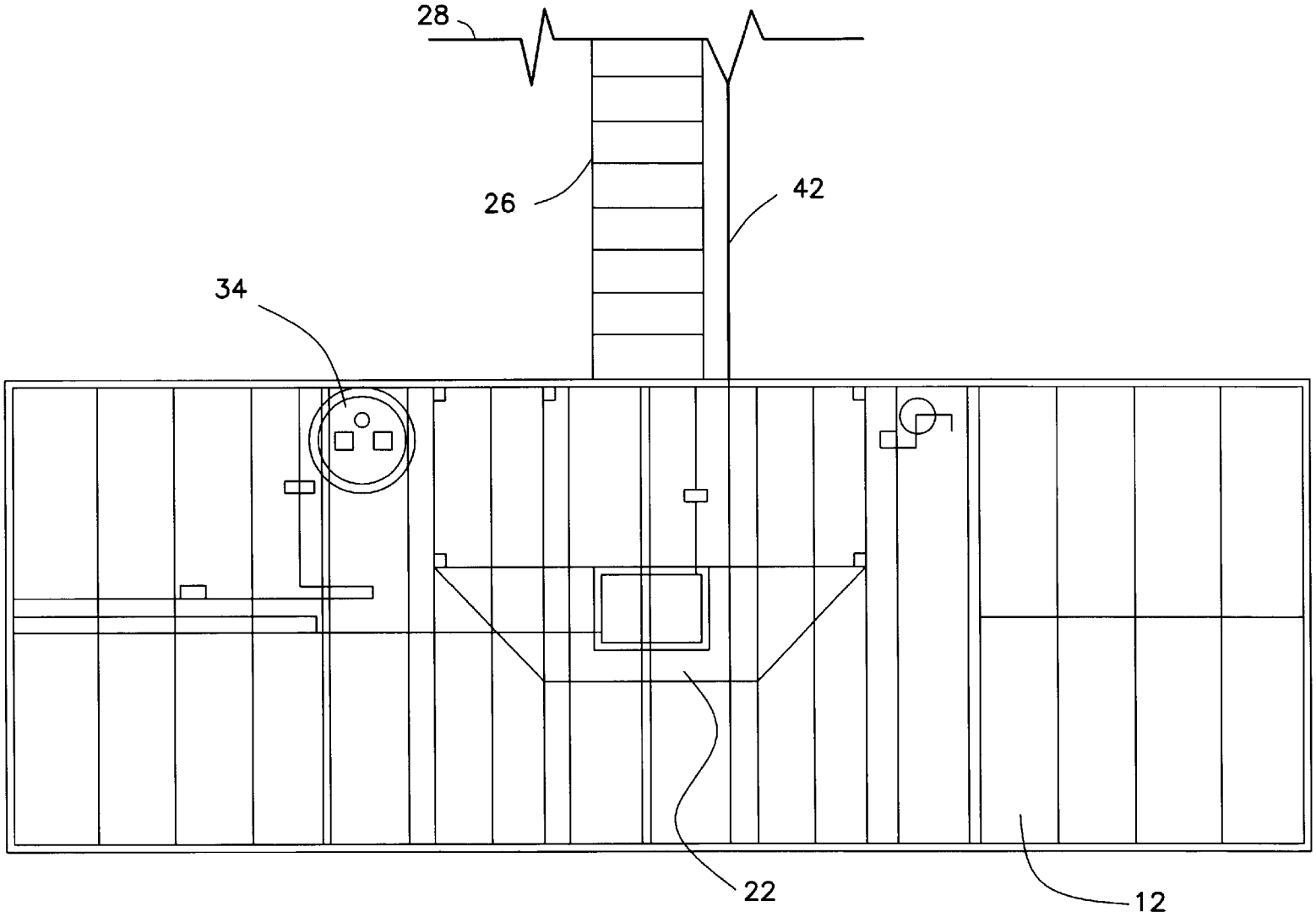
FIG. 3 is a top plan view of the facility that is shown in FIGS. 1 and 2.

In the preferred embodiment, there are two sources of power for the facility 10. The first is a power supply line 42, best shown in FIG. 3, that is connected to the facility 10 at a first end and to a shore-based source of power at a second end. The second is a solar power system 32 that is mounted above the hood 22. Alternatively, only one of the two power supply systems would be used.

Looking now to FIG. 1, it will be seen that the barge 14 includes an outer layer cover member 38, which is preferably fabricated from fiberglass, that covers the storage tank 16. A spill containment space 40 is defined between the outer layer cover member 38 and the storage tank 16 for providing secondary containment for any fuel that might leak from storage tank 16. Preferably, the system also includes a subsystem 90 for detecting any leakage of fuel that might occur into the interstitial space. This preferably is embodied as a thin pipe that extends to the bottom of the interstitial space that has an electronic sensor at the end to detect liquid. Such a sensor can be obtained from OPW of Cincinnati, Ohio as Model No. 7AM-5006.

As may best be seen in FIGS. 1 and 2, facility 10 further includes a pressure/vacuum working vent 92 that is constructed to allow expansion and contraction of the gases within the tank 16. Such a vent is available from Morrison Bros. Co. of Dubuque, Iowa as Model No. 749. Facility 10 further includes an emergency vent 94 to allow for rapid escape of flammable gases in the event of fire-related emergency, thereby eliminating the risk of an explosion.

In operation, a marine craft such as a boat is first positioned next to the floating refueling facility 10. The marine craft is then refueled by using the floating marine facility, and specifically the pumping system 18 in a manner that is old and well-known. The marine craft is then moved away from the facility. As a result of the construction of the facility 10, and the inclusion of the storage tank 16 in the facility 10, a fueling transaction can be performed without an excess of unprotected piping between the storage tank and the marine craft, thereby reducing the potential for accidents and marine pollution. In addition, the body of water provides cooling to the storage tank 16, which protect the tanks from the possibility of overheating in the event of a fire-related emergency.

Figure 4:
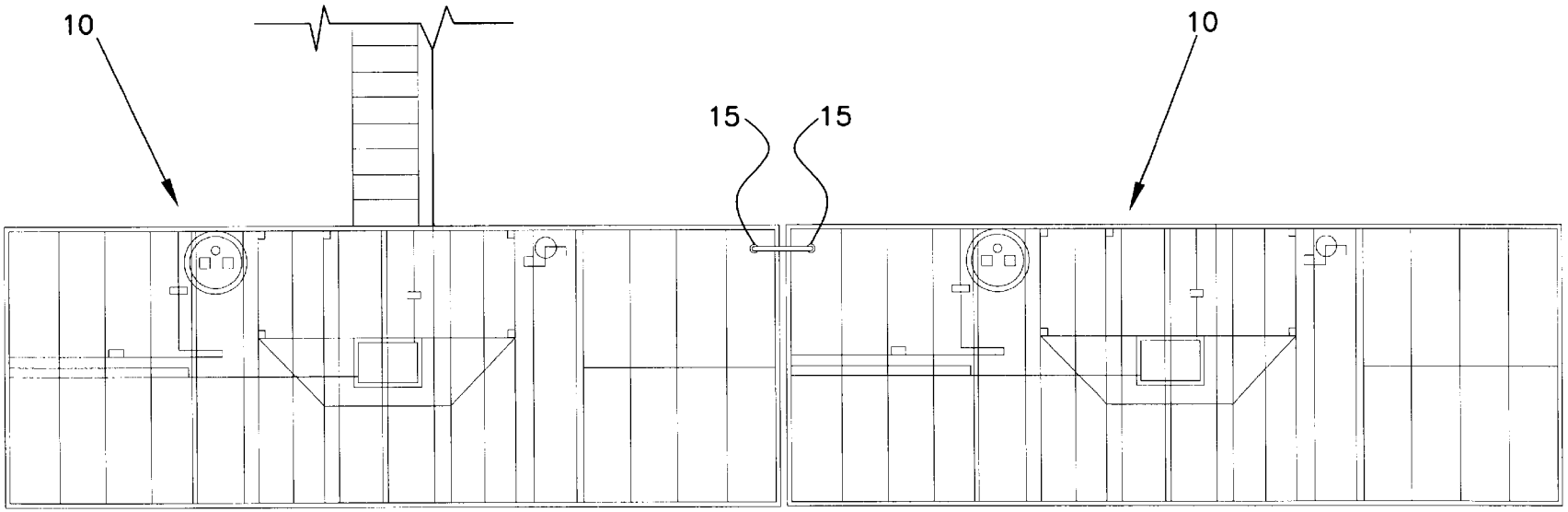
FIG. 4 is a top plan view of two such facilities connected together in modular fashion according to a preferred embodiment of the invention.
Figure 5:
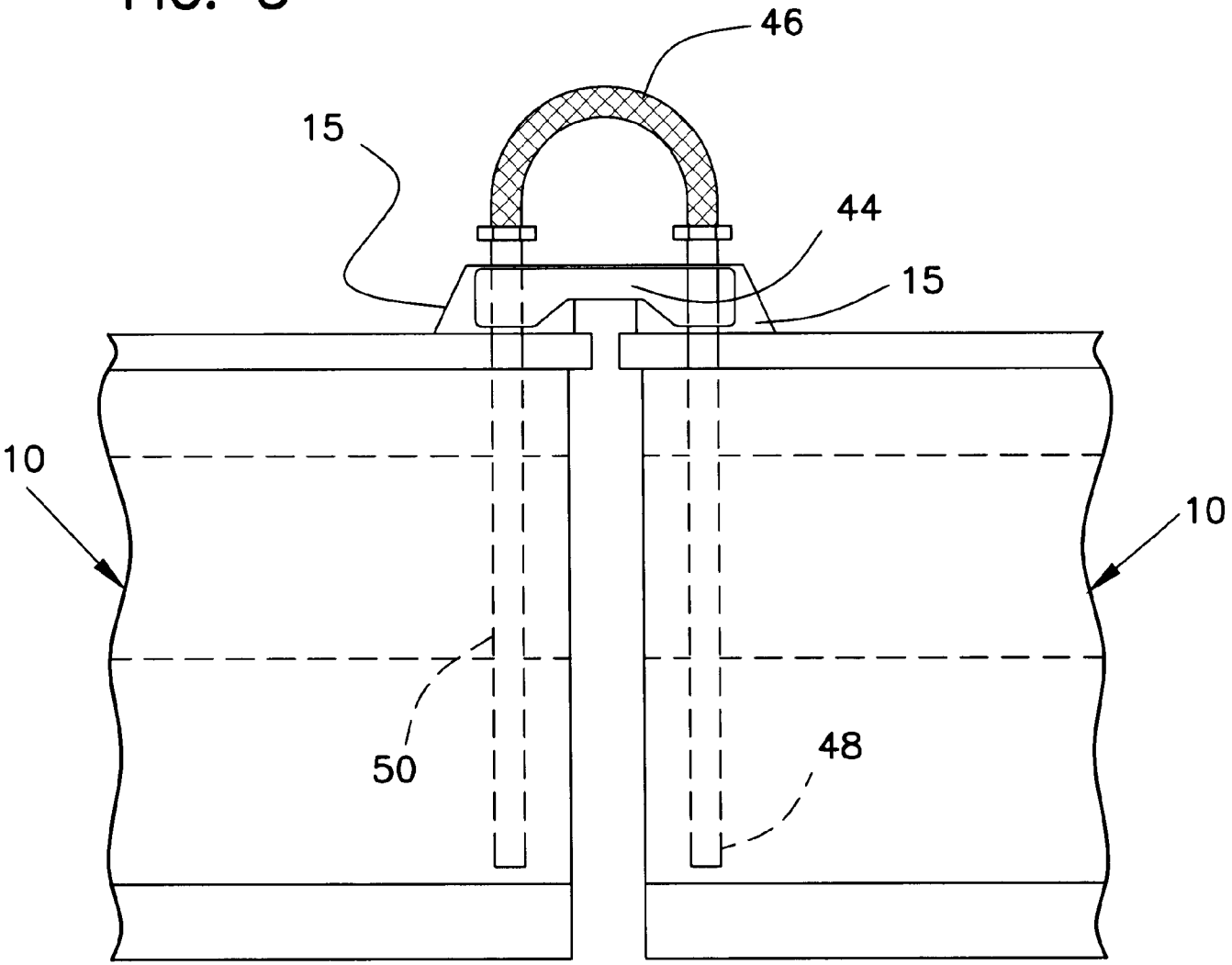
FIG. 5 is a diagrammatical side elevational view depicting how the facilities shown in FIG. 4 are connected together.

Another aspect of the invention is shown in FIGS. 4 and 5. As may be seen in FIG. 4, the facility 10 can be joined together in modular fashion with other such facilities 10, or, as is preferred with other facilities 10 not having the fuel dispensing structure, but having storage tanks. As may be seen in FIGS. 4 and 5, the facilities 10 are joined together by means of the lifting lugs 15, which are tied together by a structural bracket 44. In order to provide for even dispensing of fuel from the respective tanks of the facilities 10, a unique siphon transfer arrangement is provided that preferably includes a flexible hose 46 having a first end 48 that is immersed in the fuel in one facility 10, and a second end 50 that is immersed in the fuel that is stored in the adjacent facility 10. Should a marine craft collide with the facility 10, only a portion of the fuel therein can be discharged due to the internal bulkheads and attached modules with safety devices. As a third benefit, the facility 10 can easily be moved from one location to another within a marina or a given body of water by towing, without the use of heavy lifting equipment. Moreover, the size of each module is designed such that they can easily be trailered on standard flatbed trailers using a conventional boat ramp.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A marine refueling facility for effecting marine fueling transactions, comprising:

a buoyant platform comprising an unpowered barge that is adapted to float above a water level in a body of water such as a lake;

means for anchoring said barge in a fixed position, said anchoring means comprising a walkway that is physically secured to said barge at one end, and to a dock at a second end;

a storage tank mounted to said platform for storing a quantity of fuel;

means for providing secondary containment about said storage tank; and pumping system means for permitting a customer to refuel a boat from fuel that is extracted from said storage tank;

whereby a fueling transaction can be performed without an excess of unprotected piping between the storage tank and the boat, thereby reducing the potential for accidents and marine pollution.

2. A facility according to claim 1, wherein said barge is constructed so that said storage tank is at least partially submerged during operations, whereby the body of water will have a moderating effect on the temperature of fuel that is container within said storage tank.

3. A facility according to claim 1, wherein said storage tank has baffles positioned therein to retard shifting of the fuel within the tanks, thereby enhancing the float stability of the platform.

4. A facility according to claim 1, further comprising a power line that is connected to said facility at a first end and to a shore-based source of power at a second end for supplying power to the facility.

5. A facility according to claim 1, further comprising a solar power system for providing power to said pumping system.

6. A facility according to claim 1, wherein said pumping system means is automated so as to permit a fueling transaction to be performed without the aid of an attendant.

7. A facility according to claim 6, wherein said pumping system means includes means for receiving payment information from a customer.

8. A facility according to claim 1, further comprising means for coupling said facility to another like facility, whereby such facilities can be joined together in modular fashion.

9. A facility according to claim 8, wherein said facility is constructed so as to be haulable on a standard road trailer.

10. A marine refueling facility for effecting marine fueling transactions, comprising:

a buoyant platform comprising an unpowered barge that is adapted to float above a water level in a body of water such as a lake;

means for anchoring said barge in a fixed position, wherein said anchoring means comprises an electrically conductive portion that helps ground said refueling facility;

a storage tank mounted to said platform for storing a quantity of fuel;

means for providing secondary containment about said storage tank; and pumping system means for permitting a customer to refuel a boat from fuel that is extracted from said storage tank; whereby a fueling transaction can be performed without an excess of unprotected piping between the storage tank and the boat, thereby reducing the potential for accidents and marine pollution.

11. A mobile, modular, highway transportable marine fueling unit for effecting marine fueling transactions, comprising:

a buoyant platform that is adapted to float above a water level in a body of water such as a lake;

a storage tank mounted to said platform for storing a quantity of fuel;

means for providing secondary containment about said storage tank;

modular connecting means for connecting said unit to at least one like unit for in order to build a fueling facility of desired capacity; and wherein said unit is shaped and sized so as to be highway-transportable using standard flatbed trailers.

12. A unit according to claim 11, wherein said modular connecting means comprises at least one lug.

13. A unit according to claim 11, further comprising pumping means for dispensing fuel from said storage tank.

14. A mobile, highway transportable marine fueling unit for effecting marine fueling transactions, comprising:

a buoyant platform that is adapted to float above a water level in a body of water such as a lake;

a storage tank mounted to said platform for storing a quantity of fuel;

means for providing secondary containment about said storage tank; and pumping means for dispensing fuel from said storage tank; and wherein said unit is shaped and sized so as to be highway-transportable using standard flatbed trailers.

* * * * *